United States Patent [19]

Kotone et al.

[11] Patent Number: 4,566,675

[45] Date of Patent: Jan. 28, 1986

[54] CONTROL DEVICE FOR AN AIR HOIST

[75] Inventors: Yoshiharu Kotone, Nishinomiya; Masaaki Hiraoka, Nara, both of Japan

[73] Assignee: Nippon Pneumatic Manufacturing Co., Ltd., Osaka, Japan

[21] Appl. No.: 708,037

[22] Filed: Mar. 5, 1985

Related U.S. Application Data

[63] Continuation-in-part of Ser. No. 468,993, Feb. 23, 1983, abandoned.

[30] Foreign Application Priority Data

Dec. 1, 1982 [JP] Japan ..... 57-211803

[51] Int. Cl.[4] ..... B66D 1/08; B66D 5/02

[52] U.S. Cl. ..... 254/360; 254/377

[58] Field of Search ..... 254/228, 291, 315, 361, 254/377, 360, 314; 60/905

[56] References Cited

U.S. PATENT DOCUMENTS

| | | | |
|---|---|---|---|
| 2,874,989 | 2/1959 | Reynolds | 254/360 X |
| 3,032,016 | 5/1962 | Smith | 254/360 X |
| 3,125,200 | 3/1964 | Kaman | 254/360 X |
| 3,758,079 | 9/1973 | Workman et al. | 254/360 |
| 3,960,362 | 6/1976 | Griffiths et al. | 254/360 X |

FOREIGN PATENT DOCUMENTS

| | | | |
|---|---|---|---|
| 577005 | 6/1959 | Canada | 254/360 |

*Primary Examiner*—Stuart S. Levy
*Assistant Examiner*—Joseph J. Hail, III
*Attorney, Agent, or Firm*—Wenderoth, Lind & Ponack

[57] ABSTRACT

A control device for an air hoist drives an air motor rotated by an air supply. The air hoist lifts or lowers a load by rotating a chain wheel. When the chain wheel rotates to lower the load, a small amount of air is supplied to the air motor in order to drive it in the normal lifting direction so that the braking force generated by the motor may reduce the load lowering speed and may gradually lower the load utilizing its own weight. Also, a mechanism for restraining the rotation in the normal lifting direction, when the chain wheel is under slow speed control, is actuated to restrain the rotation of the air motor, thereby stopping the chain wheel in a safe and sure manner without using a mechanical brake.

2 Claims, 10 Drawing Figures

12
11
M
IV
VII
71
M'
61
III
C
29
62
14
A
15
16
55
20
22
B
VII
21
III
IV
23
24
13

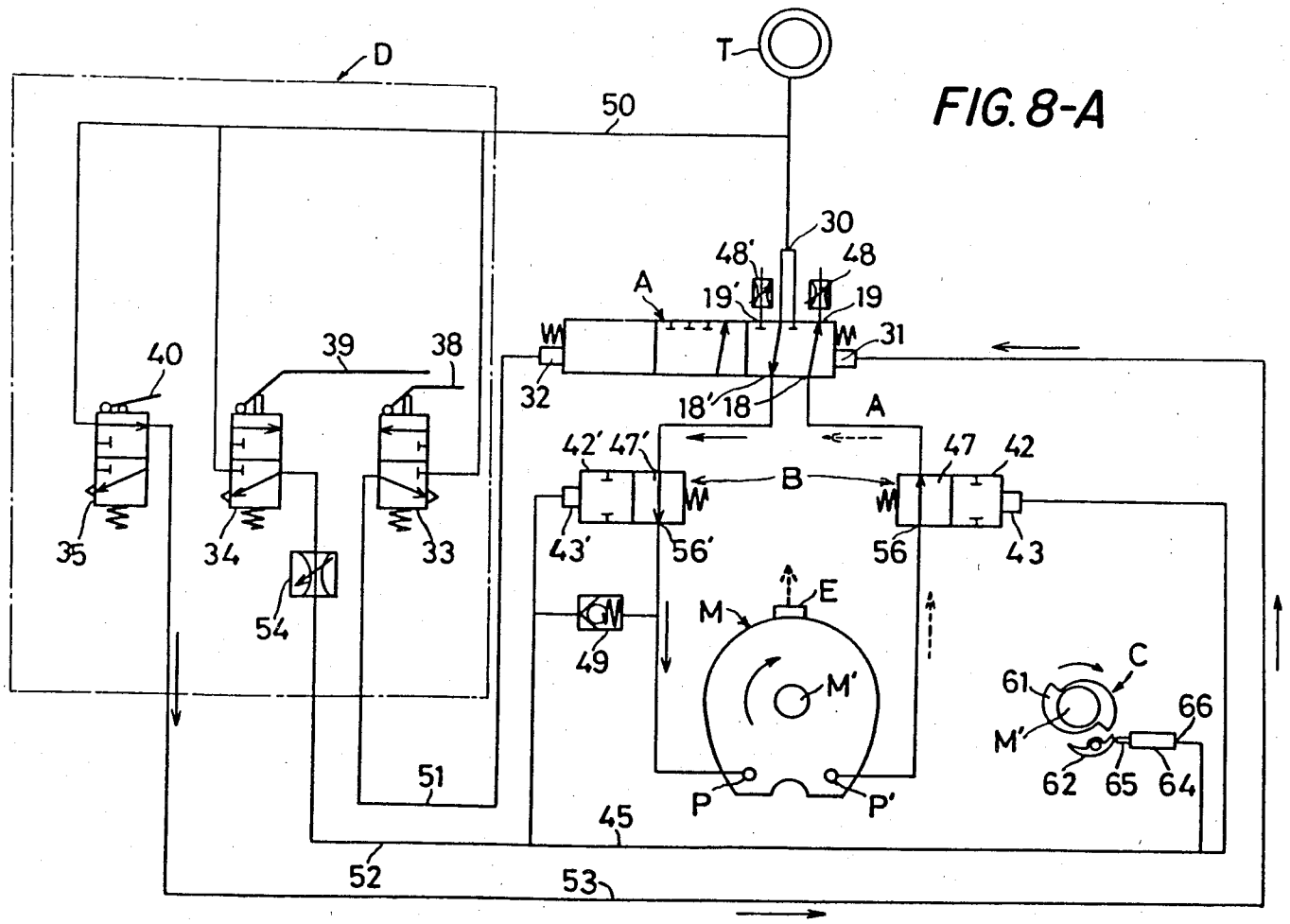
FIG. 8-A

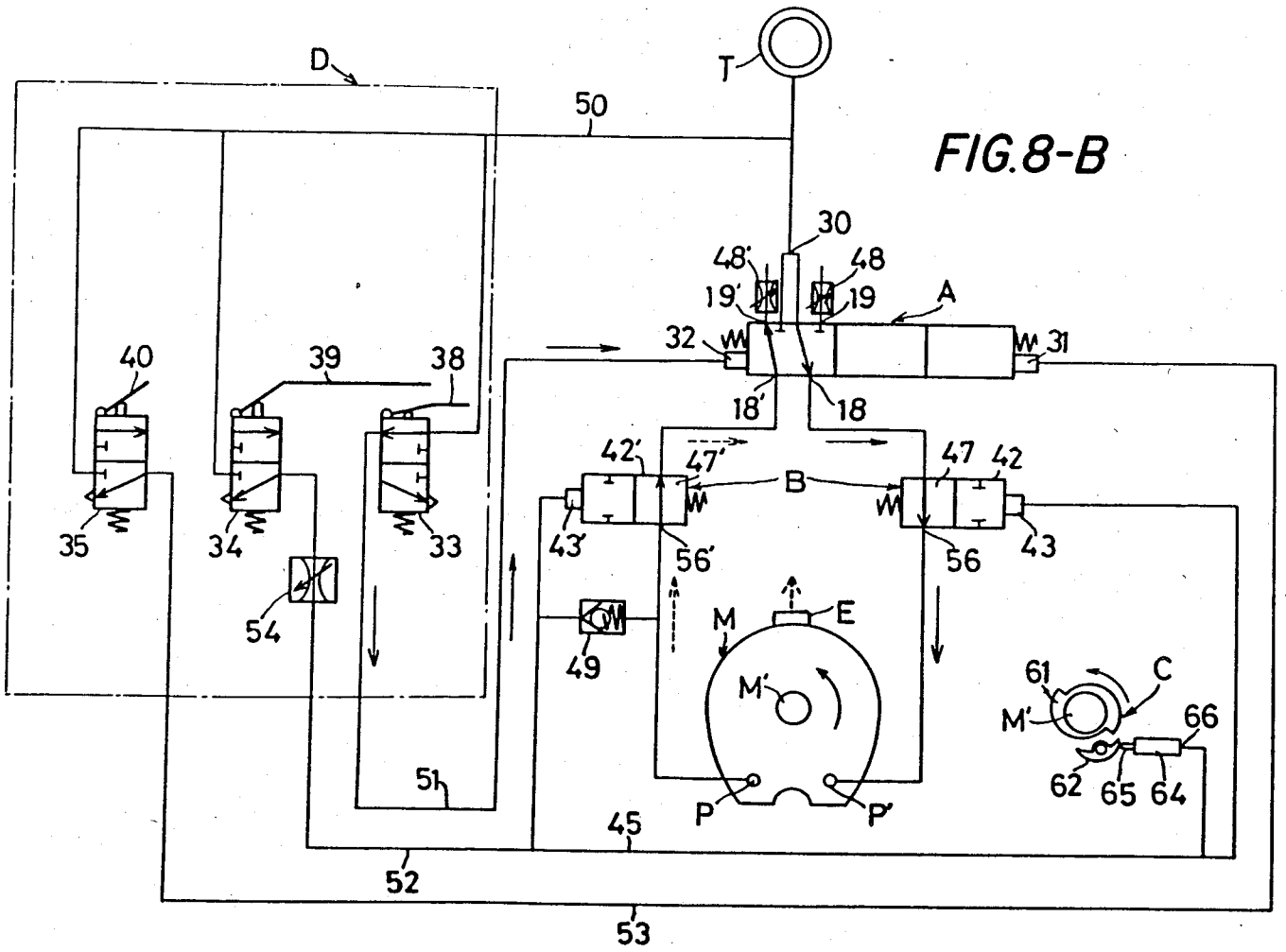
FIG. 8-B

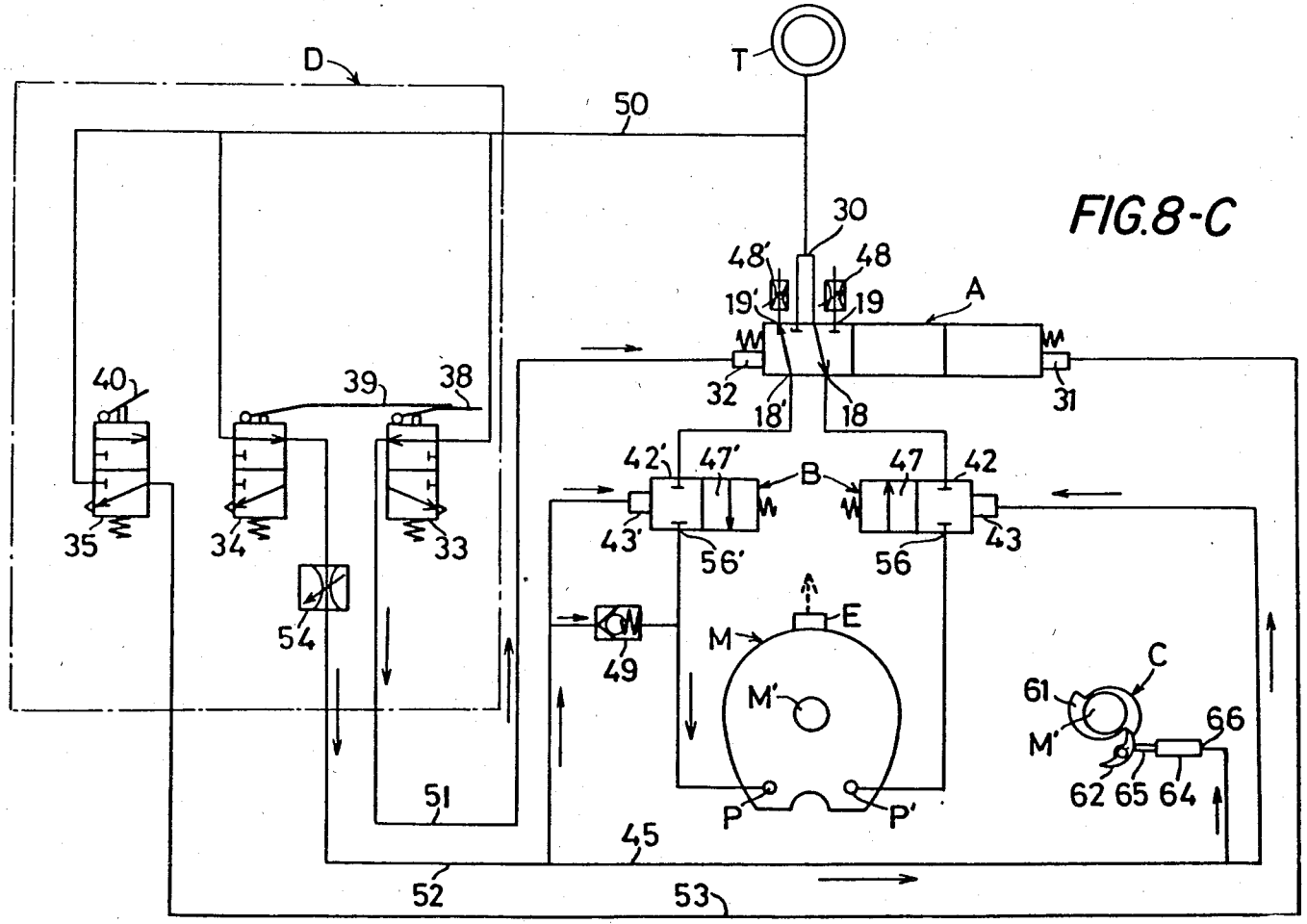
FIG.8-C

CONTROL DEVICE FOR AN AIR HOIST

CROSS-REFERENCE TO RELATED APPLICATION

This application is a continuation-in-part application of Ser. No. 468,993, filed Feb. 23, 1983, now abandoned.

BACKGROUND OF THE INVENTION

1. Field of the Invention

The present invention relates to a control device for an air hoist which lifts or lowers a load in such a manner that an air motor control valve is operated by a cylinder actuated by a manual throttle valve operable by a worker by hand so that an air motor may be driven to rotate a chain wheel and move a chain.

2. Description of the Prior Art

Air hoists driven by an air motor to rotate a chain wheel include the following types: first, a pull rope manually operated to swing a lever and control an operating valve for the air motor, thereby adjusting the rotational direction and rotational speed thereof to control the lifting speed and the lowering speed; second, a manual throttle valve operated by a worker by hand to actuate an air cylinder, by which a control valve for an air motor is operated; and third, both the pull rope and the manual throttle valve provided with an air hoist having a mechanical brake.

The first type of air hoist is advantageous in that a fine adjustment is possible by operating the operating valve little by little but the operation requires a great amount of skill and also is very dangerous for the worker since he is obliged to work just below the hanging load. Moreover, the mechanical braking action should be successively exerted, thereby avoiding a frictional heat generated to shorten the span of life of a brake.

The second type of air hoist, in which the air cylinder is operated by the manual throttle valve, is operable apart from the load so as to be safer than the first type of air hoist but it is difficult to minutely adjust the speed of the air motor, especially when the load is being lowered.

That is to say, when the air motor is rotated to gradually lower the load while the mechanical brake is released, it is difficult for the worker, who controls the manual throttle valve by hand, to carry out the fine adjustments since the load is hard to lower at slow speed and the air motor tends to rotate quickly, resulting in the danger of lowering the load too fast and the difficulty of stopping the hanging load at the chosen position.

Accordingly, it is an object of the present invention to provide a control device for an air hoist capable of lowering the load in safety and with accuracy by means of an air motor without using a mechanical brake in the lowering phase at either fast or slow speed. The control device for the air hoist is also free from overheating or breaking down of the mechanical brake.

It is another object of the present invention to provide a control device for an air hoist which can perform the lowering of the load at slow or fast speed merely by changing over the lever for the manual throttle valve, thereby efficiently operating the air hoist.

It is still another object of the present invention to provide a control device for an air hoist which can keep the chain stationary without rotation of the air motor even when the worker operates the manual throttle valve for speed reduction control by mistake. Thereby, improvement in the safety of the operation of the invention can be expected.

These and other features of the present invention will become more apparent from the following detailed description with reference to the accompanying drawings.

BRIEF DESCRIPTION OF THE DRAWINGS

FIG. 8 is a circuit diagram of the air supply according to the present invention in which FIG. 8-A shows the state of the circuit during the time when a load is being lifted, FIG. 8-B shows the state of the circuit during no-load lowering, and FIG. 8-C shows the state of the circuit during slow speed lowering.

DETAILED DESCRIPTION OF THE PREFERRED EMBODIMENTS

Figure 1:
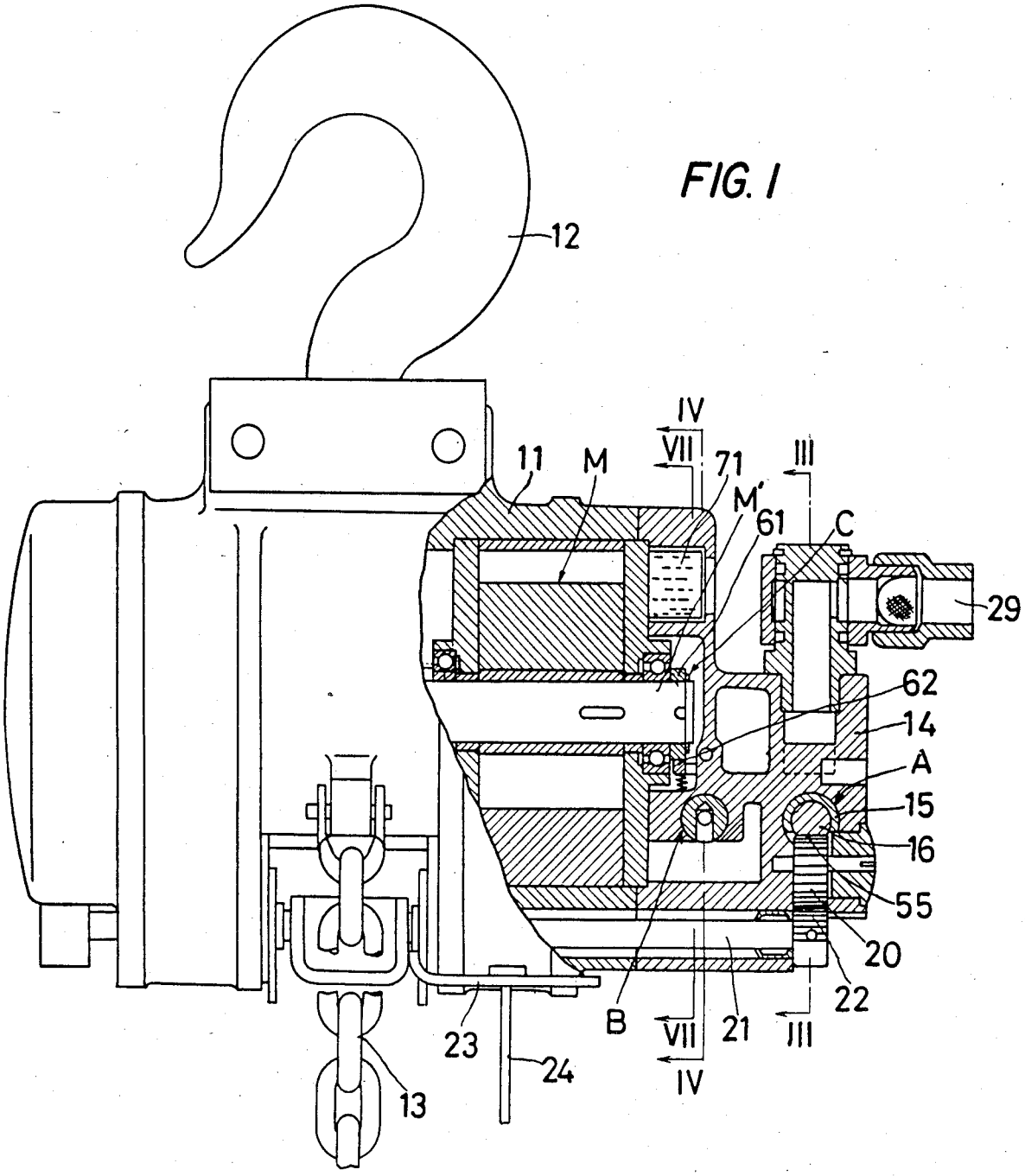
FIG. 1 is a partial vertically sectioned front view showing a preferred embodiment of a control device for an air hoist according to the present invention.
Figure 2:
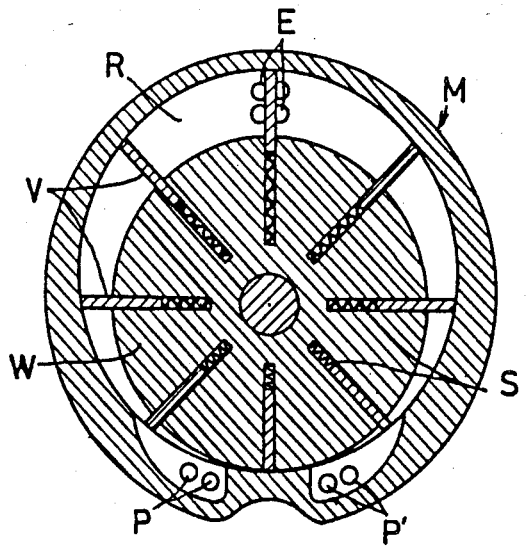
FIG. 2 is a schematic drawing showing the construction of an air motor.
Figure 3:
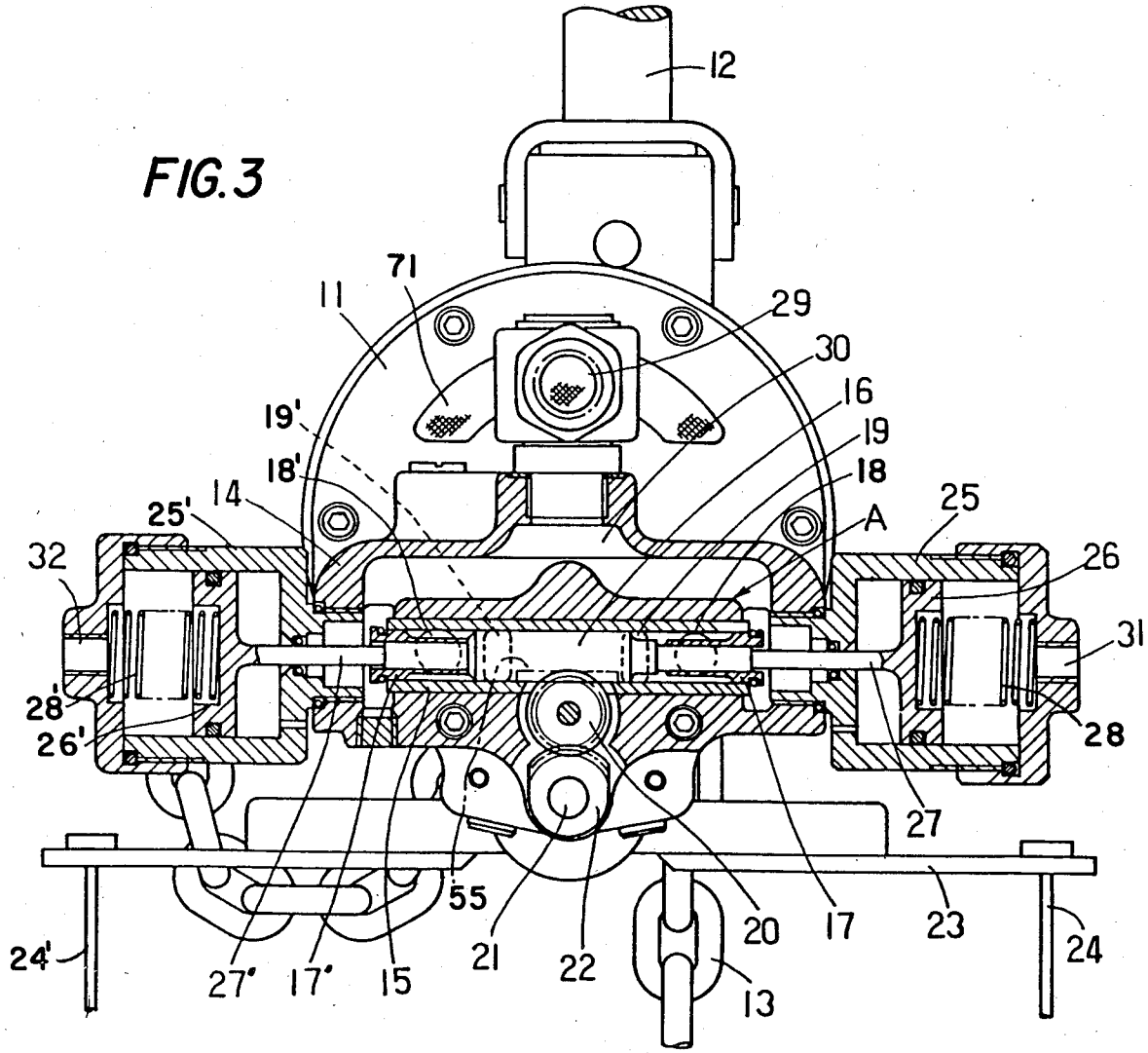
FIG. 3 is a longitudinal sectional side view of FIG. 1 taken along the line III—III.

FIGS. 1 and 3 show a main body 11 of the air hoist in which an air motor M shown in FIG. 2 is housed and a hook 12 is provided at the upper portion thereof.

In the air motor M of FIG. 2, a vane wheel W having a plurality of movable vanes V pressed in the radial direction by means of a spring S is pivoted in a rotational chamber R eccentrically and rotatably so that a part of said vane wheel W may touch internally said rotational chamber R. An air supply port P for lifting and an air supply port P′ for lowering are provided on both sides of the internally touching portion of said vane wheel W. An exhaust port E is provided on the opposite side of said internally touching portion, whereby air flows into said rotational chamber R through said air supply port P and acts on said movable vanes V, which are rotated touching internally said rotational room R, to make said vane wheel W rotate in the normal lifting direction. The air then is exhausted through said exhaust port E.

In addition, air left between said movable vanes V without being exhausted through said exhaust port E is led to said air supply port P′ for lowering and is slightly compressed before being exhausted through a silencing chamber 71.

A chain 13 fixed to said main body 11 at one end thereof engages with a chain wheel (not shown) driven by said air motor M and carries a hook (not shown) at the other end thereof.

A valve box 14 is fixed to said main body 11 at one end thereof and houses an operating valve A and a control valve B for said air motor M therein.

Said operating valve A, as shown in FIG. 3, comprises a sleeve 15 fixed inside said valve box 14, a spool 16 fitted laterally movably in said sleeve 15, and valves 17, 17′ fitted slidably onto smaller diameter shafts at both axial ends of said spool 16, respectively, so as to alternately open and close valve seats at both axial ends of said sleeve 15. The sleeve 15 is provided with a right air supply port 18 and a left air supply port 18' communicating with the control valve B and a right exhaust port 19 and a left exhaust port 19' communicating with said exhaust port E. The exhaust ports 19, 19' communicate with said exhaust port E through adjustable throttle valves 48, 48' (FIG. 8).

A pinion 20 (FIG. 3) is provided rotatably in said valve box 14. Said pinion 20 engages with a rack 55 provided at the lower side of said spool 16 so that said spool 16 may be moved right or left, whereupon said pinion 20 may be rotated. A gear 22 is provided at a lever shaft 21 and is rotatably mounted on said valve box 14. Pull ropes 24, 24' are attached to both ends of a lever 22 fixed to said lever shaft 21 so that said spool 16 may be operable by means of said pull ropes 24, 24'. Said lever shaft 21 also opens and closes the mechanical brake which may be a hand brake used with a cam but the detailed description thereof is omitted since the construction thereof is known.

Still referring to FIG. 3, cylinders 25, 25' are fixed to both ends of said valve box 14. Pistons 26, 26' fitted into said cylinders 25, 25' allow shafts 27, 27' projected from said pistons 26, 26' to come into contact with both axial ends of said spool 16. Thereby, said pistons 26, 26' are urged toward said spool 16 by means of springs 28, 28', respectively, to make said spool 6 always hold its neutral position.

In addition, said valve box 14 is provided with an air inlet 29 communicating with a compressed-air source T (FIG. 8) such as an air compressor. Said air inlet 29 communicates with said valve seats provided at both ends of said sleeve 15 through a conduit 30 provided inside said valve box 14, whereby said air supply ports 18, 18' and said exhaust ports 19, 19' are cut off from said conduit 30 by said valves 17, 17'. In addition, in FIG. 3, connecting ports 31 and 32 are provided at the outer ends of said cylinders 25, 25'.

Figure 6:
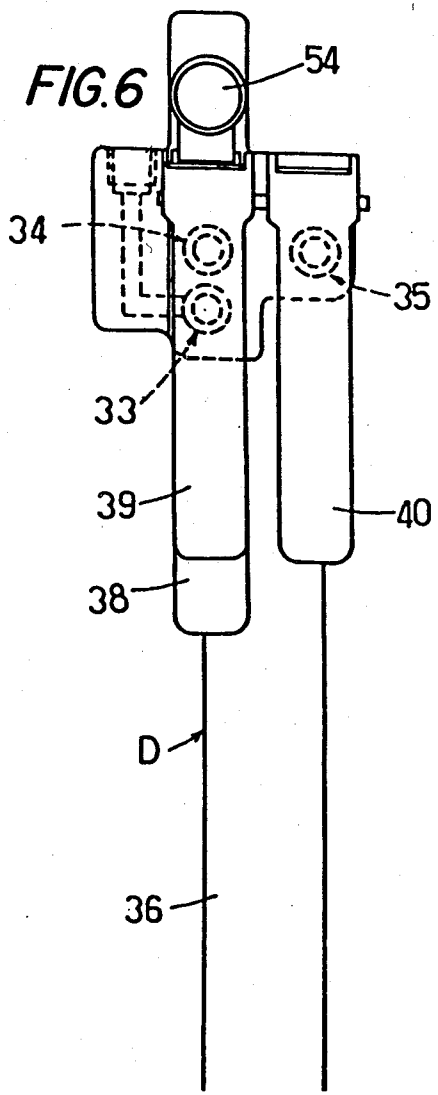
FIG. 6 is a front view of the tool shown in FIG. 5.
Figure 5:
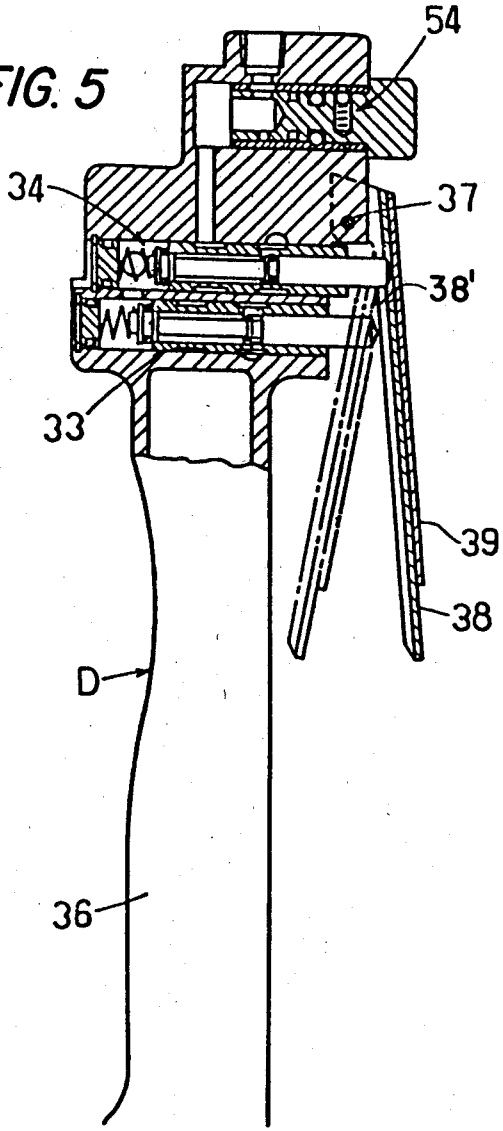
FIG. 5 is a longitudinal sectional view showing the essential parts of a tool operated by hand.

FIGS. 5 and 6 show a remote control tool D provided with three throttle valves 33, 34, 35, a handle bar 36, and three levers 38, 39, 40 turning around a stem 37. Said levers 38, 39 are overlapped with each other and are used for lowering the load. Said throttle valve 34 contacts said lever 39 through a hole 38' provided in said lever 38. Said lever 39, when pushed, pushes said lever 38 to open said valve 34 first and subsequently opens said valve 33. Said lever 38, when pushed at its lower end, alone opens said valve 33 only.

Said lever 40 is used for lifting the load and, when pushed, opens said throttle valve 35. These throttle valves 33, 34, 35 are restored by the action of a spring. In addition, an adjustable throttle valve 54 is connected with an outlet side of said throttle valve 34.

Figure 4:
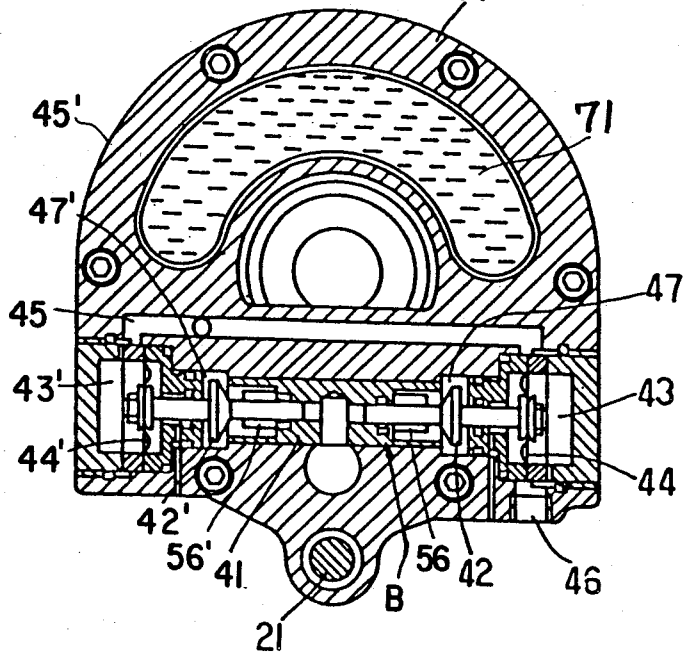
FIG. 4 is a longitudinal sectional side view of FIG. 1 taken along the line IV—IV.

Said control valve B for said air motor M is constructed as shown in FIG. 4. That is to say, a sleeve 41 fixed in said valve box 14 is provided with valve seats at both axial ends thereof and valve bodies 42, 42' for opening or closing said valve seats are slidably mounted thereon. Each of said valve bodies 42, 42' is connected with each of diaphragms 44, 44' provided in each of diaphragm chambers 43, 43' at the outer end of their valve shafts so that said diaphragm chambers 43, 43' outside said diaphragms 44, 44' may be connected with each other through a communicating conduit 45. Said valve box 14 is provided with a communicating port 46 opened into said communicating conduit 45.

Furthermore, chambers 47, 47' provided outside both ends of said sleeve 41 are allowed to communicate with said air supply port P' for lowering the load and with air supply port P for lifting the load through ports 56 and 56' at both lateral sides shown in FIG. 4.

Figure 7:
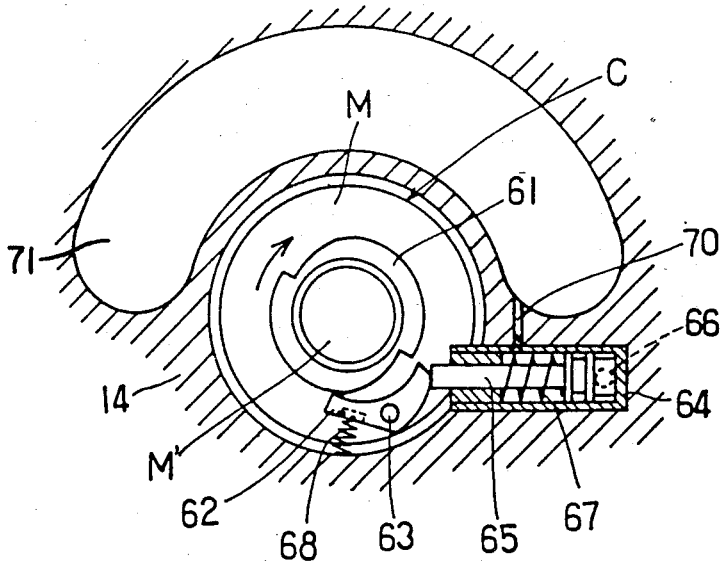
FIG. 7 is a side view showing the air motor taken along the line VII—VII in FIG. 1.

Furthermore, as shown in FIGS. 1 and 7, a ratchet wheel 61 is fixed to a motor shaft M'. A ratchet 62 engageable with said ratchet wheel 61 is mounted pivotally on said valve box 14 by means of a pin 63 at the central portion thereof and the rear end of said ratchet 62, in relation to the normal direction of rotation indicated by an arrow around said ratchet wheel 61, is energized toward the side of said ratchet wheel 61 by means of a spring 68.

An air cylinder 64 is fitted into said valve box 14. A mechanism C for restraining the rotation in the normal direction is constructed so that the utmost end side of said ratchet 62 may be pushed to engage said ratchet 62 with said ratchet wheel 61 when the utmost end rod of a piston 65 reciprocating within said air cylinder 64 comes out against a spring 67 by the action of air flowing into said cylinder 64 through an air conduit 66.

Accordingly, when said piston 65 is restained inside the air cylinder 64, said mechanism C allows the rotation of said motor M in either the normal direction or the reverse direction by pressing said spring 68 against the circumferential surface of said ratchet wheel 61 to make the rear end of said ratchet 62 go back. But, when said piston 65 is extended outside the air cylinder 64 and the pointed end of said ratchet 62 is pressed against said ratchet wheel 61, the rotation in the normal direction is prevented while the rotation in the reverse direction is allowed.

Said air conduit 66, as shown in FIGS. 8-A-C, is communicated with a part of said communicating conduit 45 connecting said slow speed lowering throttle valve 34 with said air motor control valve B. A chamber of said cylinder 64 on the side where said piston 65 comes out is provided with an exhaust port 70 (FIG. 7) communicating with said silencing chamber 71 (FIG. 7).

Referring to FIGS. 8-A-C which are circuit diagrams showing the connected parts, said compressed-air source T is connected with an inlet side port of each one of said throttle valves 33, 34, 35 through said flexible hose 50. As shown in FIG. 1, air inlet 29 of said body 11 communicates with said conduit 30 (FIGS. 8-A-C) of said operating valve A.

In addition, said connecting port 31 of said cylinder 25 (FIG. 3) for actuating said operating valve A is connected with the exit side port of said throttle valve 35 (FIGS. 8-A-C) through said flexible hose 53 while said connecting port 32 of said cylinder 25 (FIG. 3) is connected with the exit side port of said throttle valve 33 (FIGS. 8-A-C) through said flexible hose 51.

Furthermore, said communicating port 46 (FIG. 4) connunicating with said communicating conduit 45 (FIGS. 8-A-C) for communicating the outside chambers of said diaphragm chambers 43, 43' of said control valve B shown in FIG. 4 is connected with the exit side port of said throttle valve 34 (FIGS. 8-A-C) through said flexible hose 52 and said adjustable throttle valve 54. A check valve 49 (FIGS. 8-A-C) is connected between the outside chamber of said chamber 43' of said control valve B and said air-supply port P of said air motor M for lifting. Said air conduit 66 of said air cylinder 64 of said mechanism C for restraining said air motor M from normal rotation communicates with an air inlet 45' (FIG. 4) provided in said communicating conduit 45.

In addition, referring again to FIGS. 8-A–C, said air supply port 18 of said operating valve A is connected with the outside chamber 47 of said control valve B. Said air supply port 18' of said operating valve A is connected with the outside chamber 47' of said control valve B. Said air supply port 56 of said control valve B is connected with said air supply port P' for lowering of said air motor M. Said air supply port 56' of said control valve B is connected with said air supply port P for lifting of said air motor M.

Now, the operation of a control device for an air hoist according to the present invention constructed as discussed above will be described.

First, explanation will be given about load lifting in FIG. 8-A. The hook at the lower end of said chain 13 (FIG. 1) at first is engaged with a desired object and then only said lifting lever 40 (FIG. 6) of said remote control tool D at hand is pushed to push said throttle valve 35 open, so that air from said compressed-air source T (FIGS. 8-A–C) flows into said right connecting port 31 of said operating valve A from said hose 50, through said throttle valve 35, and through said hose 53. As shown in FIG. 3, air then enters said cylinder 25 to push said piston 25 leftwardly, whereby said spool 16 moves leftwardly and the left end of its larger diameter portion pushes said left valve body 17' open, communicating said compressed-air conduit 30 with said air supply port 18', and communicating said air supply port 18 with said exhaust port 19.

On the other hand, as shown in FIGS. 8-A–C, since air from said compressed-air source T flows into said conduit 30 through said air inlet 29 shown in FIGS. 1 and 3, air in said conduit 30 flows into said left air supply port 18' and then streams to said air supply port P for lifting the load through said chamber 47' of said control valve B and said port 56' to rotate said motor M in the normal direction, whereby lifting said chain 13 together with the object thereon occurs.

In such a case of lifting the load, air is not fed into each of the diaphragm chambers 43 and 43' of said control valve B. Said air supply port 56 or 56' of said control valve B communicates with said air supply port 18 or 18' of said operatoing valve A through said chamber 47 or 47'. The air fed into said air supply port P for lifting pushes said movable vanes V (FIG. 2) to rotate said vane wheel W in the direction of normal rotation. Then said air is discharged through an exhaust port E and said silencing chamber 71 (FIG. 3) while a small amount of air left between said movable vanes V (FIG. 2) is transferred to said air supply port P'. Being somewhat compressed by the rotation of said movable vanes V, air is then discharged through said air supply port P', said right chamber 47 of said control valve B, said air supply port 18, said exhaust port 19, and said adjustable throttle valve 48. Because air is not fed into said mechanism C for restraining the rotation in the normal direction, said motor M can be satisfactorily rotated in the normal direction. In addition, when said spool 16 (FIGS. 1 and 3) moves leftwardly as described above, said rack 55 in FIG. 3 makes said pinion 20 rotate counterclockwise. Said shaft 21 in association therewith rotates to release the mechanical brake such as a hand brake by the action of the cam, thereby releasing the braking effect from the sprocket.

Next, in a case of lowering said chain 13 at no load, when only said lowering level 38 (FIGS. 8-A–C is turned to push said throttle valve 33 open, air flows into said left connecting port 32 of said operating valve A through said hose 51, said valve 33, and said hose 50. Air then enters said cylinder 25' (FIG. 3) to push said piston 26' rightwardly, as shown in FIG. 3, whereby said spool 16 moves rightwardly, its larger diameter portion pushing said right valve body 17 open. Air in said conduit 30 then flows into said right air supply port 18, and said left air supply port 18' changes over to connect with said exhaust port 19'.

Under this condition, since said air supply ports 18, 18' of said operating valve A are changed over conversely to the above described case of lifting the load and said control valve B is under the same condition as in the case of lifting the load, air flows into said air supply port P', as shown in FIG. 8-B, for lowering the load of said air motor M to reversely rotate said motor M. Air is discharged through said exhaust port E while air left in rotational chamber R (FIG. 2) is transferred to said air supply port P (FIG. 8-B) for lifting the load while being compressed and is then discharged through said left chamber 47' of said control valve B, through said air supply port 18' of said operating valve A, through said exhaust port 19' and exits through said throttle valve 48', whereby said chain 13 is allowed to lower at fast speed.

Also, in this case, since air is not fed into either diaphragm chamber 43 or 43' of said control valve B or said mechanism C for restraining the rotation in the normal direction, reverse rotation can be smoothly carried out.

In addition, when said spool 16 (FIG. 3) moves rightward, similarly as in lifting, said pinion gear 20 is rotated by said rack gear 55 to rotate said lever shaft 21, thereby releasing the brake action of the mechanical brakes.

In addition, in a case of lowering said chain 13 when heavily-loaded (FIG. 8-C), said lever 39 is turned together with said lever 38 to push said throttle valves 33, 34 open simultaneously. In this case, since said throttle valve 34 opens first, compressed-air is fed into said diaphragm chambers 43, 43' provided outside said control valve B through an exit side port, via said throttle valve 54 and said hose 52. As shown in FIG. 4, air then presses said diaphragms 44, 44', whereby said valve bodies 42, 42' are engaged with said valve seats thereof to cut off said chamber 47 from said air supply port 56 and said chamber 47' from said air supply port 56'.

In addition, a part of a small amount of air flowing through said check valve 49 (FIG. 8-C) flowing toward said control valve B is cut off by means of said control valve B while air transferred to said air supply port P for rotating in the normal direction of said motor M actuates said motor M in such normal direction.

Subsequently, as shown in FIG. 8-C, said throttle valve 33 is opened to feed compressed-air via hose 51 into said connecting port 32 of said operating valve A, whereby said operating valve A is changed over to the state of lowering the load. Both said right control valve B and said left control valve B are in the cut-off state, so that said motor M is not driven.

In addition in FIG. 8-C, air transferred to said air supply port P for rotating in the normal direction of said motor M through said check valve 49 acts so as to allow said motor M to rotate at very slow speed. A force acting in the normal rotary direction merely controls a reverse rotary speed of said motor M due to the load without controlling a normal rotary speed of said motor M. Thus, when said motor M is rotated in a reverse direction for lowering the load, compressed-air is not consumed except for the leakage loss in said motor M, whereby the load can be lowered at very slow speed.

Under such a state as shown in FIG. 8-C, air is fed also into said mechanism C for restraining the rotation in the normal direction. Said piston 65 presses said ratchet 62 to engage said ratchet 62 with said ratchet wheel 61 while said ratchet wheel 61 is being rotated in the reverse direction together with said shaft M' of motor M. In other words, said ratchet wheel 61 is rotated while pushing back said ratchet 62, whereby said motor M can be satisfactorily rotated at very slow speed for lowering the load.

In such a case of lowering the load, the movement of said spool 16 (FIG. 3) of said operating valve A releases the mechanical brake device but said air motor M is subjected to the above described force for normal rotation at slow speed, so that the lowering motion due to the load weight can be braked, whereby said chain 13 is gradually lowered.

However, said throttle valve at hand for remote operation comprises three operating levers: one for lifting, one for lowering at normal speed, and one for lowering at slow speed. Said lever for lifting and said lever for lowering are turned in a case of lifting the load and lowering the load, respectively. Two levers, i.e. said lever for lowering at slow speed and said lever for lowering at normal speed, which are laid one upon another in FIG. 8-C, are turned at the same time in a case of lowering at slow speed.

Accordingly, in a case of normal lowering, there is the possibility that the operator pushes two levers simultaneously by mistake, whereby the lowering action at slow speed is carried out. In a case of lowering at no-load or very light-load, if such a misoperation has taken place, there is the possibility that said chain is wound up by the normal slow rotation of said air motor and the operator is injured by such a prior art device.

In a case of the above described lowering at no-load or light-load, when said lever 39 for lowering at slow speed and said lever 38 for lowering at normal speed are simultaneously turned by mistake, air, which passed through said check valve 49, tends to rotate said air motor M in the normal direction while air flown into said air conduit 66 of said mechanism C for restraining the rotation in the normal direction pushes out said piston 65, engaging one end of said ratchet 62 with said ratchet wheel 61 to restrain the rotation of said motor M in the normal direction, whereby said chain 13 is stopped from being wound up.

Even though the worker carries out the operation of lowering at slow speed by mistake at no-load or at a load smaller that a turning force of said motor in the normal direction, the worker is safe since the rotation of said motor M in the normal direction is restrained. In addition, even unskilled workers can easily and surely carry out the operation of lowering the load at slow speed while operation has required skill beforehand.

Furthermore, since the mechanical brake is released in the operation of lifting and lowering the load, an exothermic phenomenon due to friction is prevented, whereby the span of life of a brake device can be lengthened and a control device for an air hoist can be made explosion-proof.

What is claimed is:

1. A control device for an air hoist for lifting a load, comprising:

a main body housing therein a driving air motor;

a compressed air source;

an air circuit means for feeding air from the compressed air source to said air motor and for driving said air motor in the direction of normal rotation for lifting the load;

operating valve means, arranged in the air circuit means, for actuating the air motor;

a remote control tool means, provided in the air circuit means between the compressed air source and the operating valve means, for operating said operating valve means;

control valves and a check valve which are opened and closed by air, provided in the air circuit means between said air motor and said operating valve means;

a first adjustable throttle valve means, arranged in the remote control tool means, for controlling air to said check valve and said control valves;

a second throttle valve means, arranged in the remote control tool means upstream of the adjustable throttle means, for slow speed lowering of the load and for controlling air to said adjustable throttle valve means;

third and fourth throttle valve means, arranged in the remote control tool means and in the air circuit means parallel to said throttle valve means for slow speed lowering and lifting respectively, by feeding air to opposite sides of the operating valve means; and two lever means for either individually or simultaneously operating said second and third throttle valve means;

one of said two lever means being connected to said second throttle means for slow speed lowering and the other of said two lever means being connected to said third throttle valve means for normal lowering.

2. The control device for the air hoist according to claim 1, further comprising:

a brake means, arranged in the air circuit means between the adjustable throttle valve means and one of the control valves, for restraining said air motor from normal rotation during slow speed lowering.

* * * * *